US007417553B2

(12) United States Patent
Young

(10) Patent No.: US 7,417,553 B2
(45) Date of Patent: Aug. 26, 2008

(54) SURFACE MOUNT OR LOW PROFILE HAZARDOUS CONDITION DETECTOR

(76) Inventor: Scott G. Young, 52 Blackberry Trail, Aurora, IL (US) 60506

( * ) Notice: Subject to any disclaimer, the term of this patent is extended or adjusted under 35 U.S.C. 154(b) by 227 days.

(21) Appl. No.: 11/288,619

(22) Filed: Nov. 29, 2005

(65) Prior Publication Data

US 2006/0125648 A1 Jun. 15, 2006

Related U.S. Application Data

(60) Provisional application No. 60/632,321, filed on Nov. 30, 2004.

(51) Int. Cl.
*G08B 17/10* (2006.01)

(52) U.S. Cl. ..... 340/628; 340/632; 340/693.6

(58) Field of Classification Search ..... 340/628, 340/629, 630, 632, 693.6, 521, 603; 324/455, 324/464

See application file for complete search history.

(56) References Cited

U.S. PATENT DOCUMENTS

| | | | | |
|---|---|---|---|---|
| 2,765,975 | A | 10/1956 | Lindenblad | |
| 2,795,401 | A | 6/1957 | Cooper et al. | |
| 3,503,348 | A | 3/1970 | Dvirka | |
| 3,504,482 | A | 4/1970 | Goettl | |
| 3,638,058 | A | 1/1972 | Fritzius | |
| 3,678,487 | A * | 7/1972 | Ludewig et al. | 340/507 |
| 3,699,387 | A | 10/1972 | Edwards | |
| 3,751,715 | A | 8/1973 | Edwards | |
| 3,952,808 | A * | 4/1976 | Richardson | 169/61 |
| 3,973,927 | A | 8/1976 | Furchner et al. | |
| 4,076,011 | A | 2/1978 | Proulx | |
| 4,210,847 | A | 7/1980 | Shannon et al. | |
| 4,231,766 | A | 11/1980 | Spurgin et al. | |
| 4,343,776 | A | 8/1982 | Carr et al. | |
| 4,380,720 | A | 4/1983 | Fleck | |
| 4,405,507 | A | 9/1983 | Carr et al. | |
| 4,643,745 | A | 2/1987 | Sakakibara et al. | |
| 4,675,029 | A | 6/1987 | Norman et al. | |
| 4,694,817 | A | 9/1987 | Nilsson | |

(Continued)

FOREIGN PATENT DOCUMENTS

| | | |
|---|---|---|
| CA | 2117222 | 9/1995 |

(Continued)

OTHER PUBLICATIONS

Bosch Security Systems, FCP-500 Conventional Flush-Mount Smoke Detectors, page printed from website, date last visited Nov. 15, 2005, 1 page, http://www.boschsecurity.us/index.spx?prdctid=3473.

(Continued)

*Primary Examiner*—Anh V La
(74) *Attorney, Agent, or Firm*—Reinhart Boerner Van Deuren, P.C.

(57) ABSTRACT

A hazardous condition detector is provided. The hazardous condition detector comprises a body, a hazardous condition sensor, and at least one corona discharge apparatus. The body defines a passage therethrough. The passage extends between an inlet and an outlet. The hazardous condition sensor is positioned within the passage. The at least one corona discharge apparatus is positioned within the passage to draw a fluid into the passage through the inlet and to expel the fluid through the outlet.

17 Claims, 2 Drawing Sheets

U.S. PATENT DOCUMENTS

| | | | | |
|---|---|---|---|---|
| 4,789,801 | A | 12/1988 | Lee | |
| 4,812,711 | A | 3/1989 | Torok et al. | |
| 4,955,991 | A | 9/1990 | Torok et al. | |
| 5,042,997 | A | 8/1991 | Rhodes | |
| 5,055,115 | A | 10/1991 | Yikai et al. | |
| 5,071,455 | A | 12/1991 | Abedi-Asl | |
| 5,077,500 | A | 12/1991 | Török et al. | |
| 5,144,941 | A | 9/1992 | Saito et al. | |
| 5,422,331 | A | 6/1995 | Galligan et al. | |
| 5,537,096 | A | 7/1996 | Wagner | |
| 5,552,775 | A | 9/1996 | Harley | |
| 5,610,592 | A | 3/1997 | Okazaki | |
| 5,667,564 | A | 9/1997 | Weinberg | |
| 5,702,244 | A | 12/1997 | Goodson et al. | |
| 5,917,417 | A | 6/1999 | Girling et al. | |
| 5,958,112 | A | 9/1999 | Nojima et al. | |
| 6,129,781 | A | 10/2000 | Okamoto et al. | |
| 6,176,977 | B1 | 1/2001 | Taylor et al. | |
| 6,196,468 | B1 | 3/2001 | Young | |
| 6,224,481 | B1 | 5/2001 | McCabe | |
| 6,287,368 | B1 | 9/2001 | Ilmasti | |
| 6,375,902 | B1 | 4/2002 | Moini et al. | |
| 6,375,905 | B1 | 4/2002 | Moini et al. | |
| 6,464,754 | B1 | 10/2002 | Ford | |
| 6,504,308 | B1 | 1/2003 | Krichtafovitch et al. | |
| 6,508,982 | B1 | 1/2003 | Shoji | |
| 6,580,950 | B1 | 6/2003 | Johnson et al. | |
| 6,600,424 | B1 | 7/2003 | Morris | |
| 6,635,106 | B2 | 10/2003 | Katou et al. | |
| 6,635,153 | B1 | 10/2003 | Whitehead | |
| 6,664,741 | B1 | 12/2003 | Krichtafovitch | |
| 6,699,529 | B2 | 3/2004 | Garner et al. | |
| 6,727,657 | B2 | 4/2004 | Krichtafovitch et al. | |
| D499,476 | S | 12/2004 | Holderfield et al. | |
| D500,848 | S | 1/2005 | Holderfield et al. | |
| D501,042 | S | 1/2005 | Holderfield et al. | |
| 6,902,117 | B1 | 6/2005 | Rosen | |
| 7,049,824 | B2 * | 5/2006 | Shabino | 324/464 |
| 2001/0032544 | A1 | 10/2001 | Taylor et al. | |
| 2003/0090209 | A1 | 5/2003 | Krichtafovitch et al. | |
| 2003/0234618 | A1 | 12/2003 | Krichtafovitch | |
| 2004/0004440 | A1 | 1/2004 | Krichtafovitch et al. | |
| 2004/0004797 | A1 | 1/2004 | Krichtafovitch et al. | |
| 2004/0155612 | A1 | 8/2004 | Krichtafovitch | |
| 2004/0183454 | A1 | 9/2004 | Krichtafovitch | |
| 2004/0212329 | A1 | 10/2004 | Krichtafovitch et al. | |
| 2004/0217720 | A1 | 11/2004 | Krichtafovitch et al. | |
| 2005/0011512 | A1 | 1/2005 | Bachinski et al. | |
| 2005/0214186 | A1 | 9/2005 | Michalakos et al. | |
| 2006/0112708 | A1 | 6/2006 | Reaves | |
| 2006/0112828 | A1 | 6/2006 | Ehlers | |
| 2006/0112829 | A1 | 6/2006 | Ashworth | |
| 2006/0112955 | A1 | 6/2006 | Reaves | |
| 2006/0113398 | A1 | 6/2006 | Ashworth | |
| 2006/0114637 | A1 | 6/2006 | Ashworth | |

FOREIGN PATENT DOCUMENTS

| | | | |
|---|---|---|---|
| CA | 2370966AA | | 12/2000 |
| JP | 61134524 | A | 6/1986 |
| JP | 362057662 | A | 3/1987 |
| JP | 63201437 | A | 8/1988 |
| JP | 01312340 | A | 12/1989 |
| JP | 02215037 | A | 8/1990 |
| JP | 410043628 | A | 2/1998 |

OTHER PUBLICATIONS

Bosch, Award-Winning Bosch Smoke Detectors Offer Continuity in Architectural Design, press release, 2 pages, published by The Simon Group, Bosch Security Systems 130 Perinton Parkway, Fairport, NY 14450 , date : Jun. 2005.

The Sharper Image, S1857 OzoneGuard Professional Series Ionic Breeze Quadra Silent Air Purifier, pages printed from website, date last visited Nov. 14, 2005, 5 pages, http://www.sharperimagebest.com/si857.html.

Yet2.com, NoZone The Intelligent Air Freshener, pages printed from website, date last visited Nov. 14, 2005, 2 pages, http://www.yet2.com/app/list/techpak?id=36127&sid=360&abc-0.

Engelhard, PremAir catalyst now part of The Sharper Image's Ionic Breeze Air Purifiers, page printed from website, date last visited Nov. 14, 2005, http://www.engelhard.com/Lang1/xDocID1EF8CDE1FB754A8788E84A989F41EA6C/xDocTable_Cas.

Lara A. Gundel, Douglas P. Sullivan, Gregory Y. Katsapov, William J. Fisk, A pilot study of energy efficient air cleaning for ozone, report, Indoor Environment Department Environmental Energy Technologies Division Lawrence Berkeley National Laboratory, University of California, Nov. 28, 2002, 15 pages, posted at the eScholarship Repository, University of California, http://repositories.cdlib.org/lbnl/LBNL-51836.

* cited by examiner

SURFACE MOUNT OR LOW PROFILE HAZARDOUS CONDITION DETECTOR

CROSS-REFERENCE TO RELATED PATENT APPLICATIONS

This patent application claims the benefit of U.S. Provisional Patent Application No. 60/632,321, filed Nov. 30, 2004, the teachings and disclosure of which are hereby incorporated in their entireties by reference thereto.

FIELD OF THE INVENTION

This invention generally relates to hazardous condition detectors and, more particularly, to air flow through a hazardous condition detector.

BACKGROUND OF THE INVENTION

A traditional hazardous condition detector such as a smoke alarm, as illustrated in FIG. 1, is typically mounted on a wall or ceiling in an environment (e.g., a living space) within a structure. Should a fire or environmentally unsafe condition occur within the structure, any harmful substance (e.g., smoke, carbon monoxide, and the like) generated by the hazardous condition will usually ascend toward the ceiling due to natural or free rise convection. Eventually, the harmful substance will begin to flow along the wall or up to the ceiling such that the harmful substance enters the hazardous condition detector. After entering the hazardous condition detector, the harmful substance encounters a hazardous condition sensor capable of detecting the substance and activating an alarm. If the hazardous condition sensor senses a presence of the harmful substance or that the harmful substance has reached a sufficient level or amount, the sensor activates the alarm.

Unfortunately, the conventional hazardous condition detector is forced to rely upon free rise convection to move the hazardous substance past or proximity to the sensor. If circulation in the living space is poor, if the harmful substance rises slowly, if the free rise convection in the environment is somehow hampered or if the detector is placed in a non-suggested position, the harmful substance may be prevented from reaching the hazardous condition sensor even though dangerous levels of the hazardous substance are present. This could result in a loss of property, an infliction of a personal injury, and an even unnecessary loss of life.

Moreover, since the conventional hazardous condition detector requires free rise convection to move air past the hazardous condition sensor, the conventional hazardous condition detector must extend away from the wall or ceiling and project into the environment. Such an arrangement is not aesthetically pleasing to many people.

Referring to FIG. 1, a conventional hazardous condition detector 10 as known in the art is illustrated. The conventional hazardous condition detector 10 is generally mounted to a ceiling 12 or wall 13 of a structure 14 (e.g., residential dwelling, business office, and the like). As shown in FIG. 1, the conventional hazardous condition detector 10 projects outwardly and intrudes into an environment (e.g., living space) within the structure 14. The hazardous condition detector 10 may be operatively coupled to an external alarm system such that an alarm can be sounded throughout the dwelling should a harmful and/or undesirable amount or level or a harmful substance be sensed. As noted above, the hazardous condition detector 10 relies, at least in part, upon free rise convection to ensure that the harmful substance is circulated by the harmful condition sensor.

Therefore, a hazardous condition detector that can quickly and reliably sense smoke and/or other hazardous substances within the living space and can be mounted in an aesthetically pleasing manner would be desirable. The invention provides such a hazardous condition detector. These and other advantages of the invention, as well as additional inventive features, will be apparent from the description of the invention provided herein.

BRIEF SUMMARY OF THE INVENTION

The invention provides a surface mount smoke alarm or other hazardous condition detector, and a means to measure indoor air quality (IAQ). The surface mount alarm has most of the electronics behind the drywall with little or no protrusion into the living space. An ion fluid movement system is used to create the air movement into, through, and out of the hazardous condition detector. A sensor housed in the detector housing can then sense the presence of the hazardous condition, e.g. smoke. In embodiments of the invention, the use is expanded to look for hot gas, explosive gas, carbon monoxide (CO), carbon dioxide ($CO_2$), radon, mold, and other hazardous substances, materials, and conditions.

In one aspect, the invention provides a hazardous condition detector. The hazardous condition detector comprises a body, a hazardous condition sensor, and at least one corona discharge apparatus. The body defines a passage therethrough. The passage extends between an inlet and an outlet. The hazardous condition sensor is positioned within the passage. The at least one corona discharge apparatus is positioned within the passage to draw a fluid into the passage through the inlet and to expel the fluid through the outlet.

In another aspect, the invention provides a hazardous condition detector. The hazardous condition detector comprises a passage, a hazardous condition sensor, an emitter array, and a collector array. The passage extends between an inlet and an outlet. The hazardous condition sensor, the emitter array, and the collector array are disposed within the passage. The collector array is positioned in the passage in a spaced relation to the emitter array. The emitter array and the collector array cooperatively produce an electric wind in the passage when energized such that air is drawn from an environment into the passage through the inlet, moved past the sensor, and expelled through the outlet into the environment.

In yet another aspect, the invention provides a method of detecting a hazardous condition in an structure. The method comprising the step of producing an electric wind in a passage of a hazardous condition detector. The fluid is thereby drawn from an environment into the passage, circulated past a hazardous condition sensor, and expelled into the environment. As such, the fluid is monitored for the hazardous condition.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
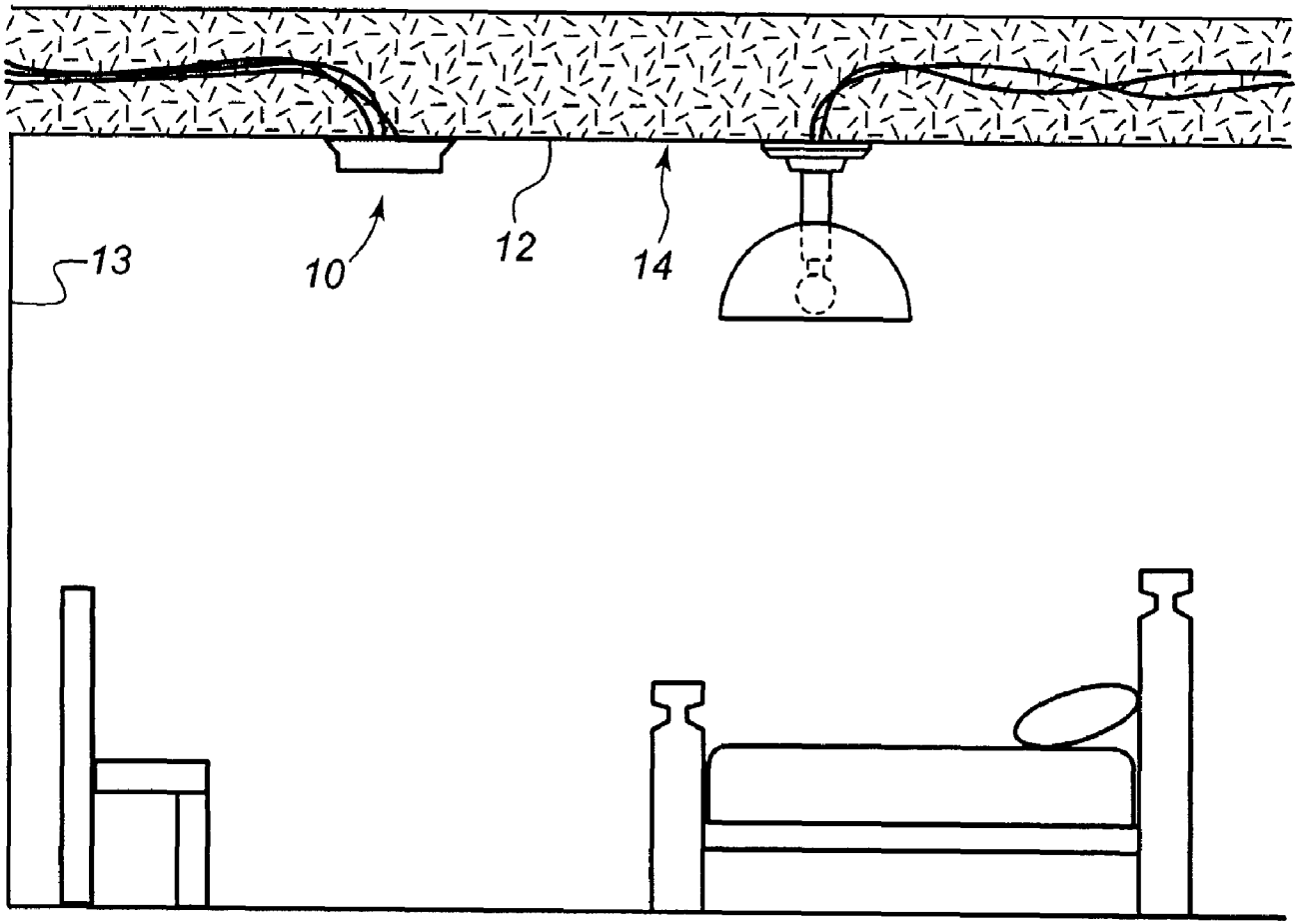
FIG. 1 (PRIOR ART)
FIG. 1 illustrates a traditional mounting arrangement for a hazardous condition detector mounted on the ceiling.
Figure 2:
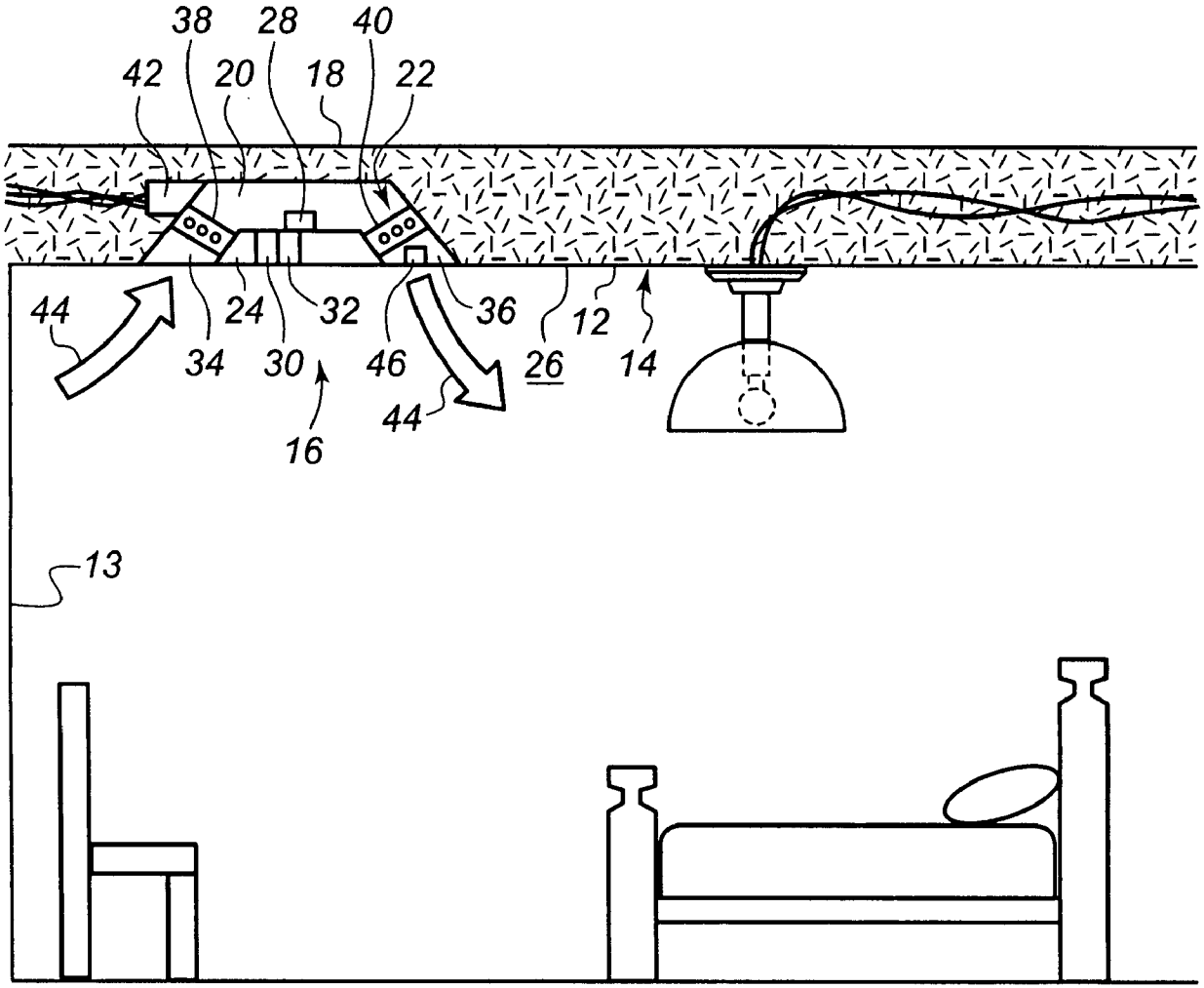
FIG. 2 illustrates an exemplary embodiment of a mounting arrangement for a hazardous condition detector enabled by the system and in accordance with the teachings of the present invention.

Referring now to FIG. 2, a hazardous condition detector 16 constructed in accordance with the teachings of the present invention is illustrated. The hazardous condition detector 16 can be an ionization detector, an optical detector, an electrochemical cell detector, a photoelectric detector, and combinations thereof as well known to those skilled in the art. The hazardous condition detector 16 comprises a body 18, a passage 20, and at least one corona discharge apparatus 22 positioned therein.

The body 18 is preferably constructed of a material such as steel, plastic, and the like. In a preferred embodiment, the body 18 is generally mounted within or above the ceiling 12 of the structure 14 such that the front face 24 of the hazardous condition detector 16 is planar with an interior surface 26 of the ceiling. In other words, the hazardous condition detector 16 is flush mounted in the ceiling 12. In one embodiment, the body 18 can also be flush mounted within the wall 13. The body 18 generally houses at least one sensor 28, one or more control components 30, an alarm system 32, and the passage 20.

The sensor(s) 28 is able to sense one or more hazardous and potentially hazardous substances in the air. In one embodiment, the hazardous condition sensor senses for the presence and/or harmful levels and amounts of at least one of smoke, carbon monoxide (CO), carbon dioxide ($CO_2$), radon, mold, hot gas, and explosive gas, and the like in the air. In a further embodiment, the sensor 28 can be configured to measure indoor air quality (IAQ). Preferably, the sensor 28 is disposed within, adjacent to, and/or in close proximity to the passage 20 so as to detect the presence of the hazardous condition in the air passing through the passage 20.

The control components 30 are devices used to control the operation and features of the hazardous condition detector 16. The control components 30 are preferably located on or in body 18 of the hazardous condition detector 16 in a manner permitting easy access for a user. The control components 30 may include, for example, one or more knobs, switches, depressible buttons, rotating dials, touch screens, controller, and the like. In some circumstances, the control components 30 can be covered and/or protected by a sliding door or pivoting cover.

The alarm system 32 is activatable when the sensor senses a presence and/or an elevated level of one or more of the hazardous and/or harmful substances in the air. In other words, the alarm system 32 can be triggered by the mere presence of a hazardous material in the air as controlled by control components 30. When activated, the alarm system 32 is capable of generating an audible and/or visual alarm. The alarm system 32 can be operatively coupled to another alarm system, to an outside alarm system or monitoring company, to a wireless device such as a cell phone, beeper, personal digital assistance, a computer, a Internet based network computer, and the like. As such, a tenant and/or owner of the structure 14 can be immediately notified of an unsafe condition in the environment.

The passage 20 is generally formed in the body 18 and extends between an inlet 34 and an outlet 36. The inlet 34 and outlet 36 each open through the front face 24 of the body 18 as shown in FIG. 2. In the illustrated embodiment, the inlet 34 and the outlet 36 are in the same plane with each other to facilitate the flush mounting of the detector 16 in the ceiling, in the wall, etc. Each of the inlet and outlet 34, 36 can be protected by a cover, a grate, and the like. At least a portion of the passage 20 is proximate and/or adjacent the sensor 28 such that the sensor can sense a one or more of the parameters of the fluid moving through, or temporarily residing in, the passage 20. Preferably, the sensor 28 is disposed within the passage 20.

The passage 20 also houses one or more corona discharge apparatuses 22. Each of the corona discharge apparatuses 22 in the passage 20 is an electrical device that relies on corona discharge and ion charge attraction to move air and, preferably, filter particles and pollutants from the air. These or this corona discharge apparatus 22 may be positioned proximate the inlet 34, the outlet 36, and/or within the passage 20 to draw air therethrough.

A typical corona discharge apparatus 22 employs numerous corona discharge electrodes 38 arranged in arrays and spaced apart from numerous negatively charged attracting electrodes 40 that are also arranged in arrays. When assembled into an array, the corona discharge electrodes 38 can be referred to as an emitter array. Likewise, the attracting electrodes 40 can be referred to a collector array. Due to the many array configurations and electrode shapes that can be used, the arrays of the corona discharge electrodes 38 and the attracting electrodes 40 have been shown in FIG. 2 in a simplified form.

Each of the corona discharge electrodes 38 and attracting electrodes 40 is coupled to and charged by a high-voltage power supply 42. The electrodes 38, 40 are also preferably controlled and/or managed by related control electronics (not shown). In addition, the corona discharge electrodes 38 are typically asymmetrical with respect to the attracting electrodes 40. In one embodiment, the corona discharge electrodes 38 are highly curved and resemble the tip of a needle or a narrow wire while the attracting electrodes 40 take the form of a flat plate or a ground plane. The curvature of the corona discharge electrodes 38 ensures a high potential gradient around that electrode.

The high potential gradient generated at or near the corona discharge electrodes 38 basically pulls apart the neutral air molecules in the immediate area. What remains after each neutral air molecule has been dismantled is a positively charged ion and a negatively charged electron. Due to the strong electric field near the corona discharge electrode 38, the ion and electron are increasingly separated from each other, prevented from recombining, and accelerated. Therefore, the ion and electron are both imparted with kinetic energy. Moreover, since a portion of the air molecules in the passage 20 is ionized, the air in the passage becomes a conducting medium, the circuit including the corona discharge electrodes 38 and the attracting electrodes 40 is completed, and a current flow can be sustained.

The negatively charged electrons are persuaded to move toward the positively charged corona discharge electrodes 38 due to the difference in charge between them. When the rapidly moving and accelerating electrons collide with other neutral air molecules in the area, further positive ion/electron pairs are created. As more and more positive/ion electric pairs are produced, an electron avalanche is established. The electron avalanche sustains and/or perpetuates the corona discharge process.

In contrast to the negatively charged electrons, the positively charged ions are persuaded to move from near the corona discharge electrodes 38 toward the attracting electrodes 40. This movement is due to the difference in charge between the positively charged ions and the negatively charged attracting electrodes. Like the electrons, when the positively charged ions move they also collide with neutral air molecules. When they collide, the positively charged ions can transfer some of their momentum as well as excess charge to the neutral air molecules. Therefore, the neutral air molecules are knocked toward the attracting electrode 40 or are ionized and then drawn to the attracting electrode. In either case, the positively charged ions and other air molecules end up flowing from the corona discharge electrodes 38 toward the attracting electrodes 40.

The movement or flow of the air particles away from the corona discharge electrodes 38 and toward the attracting electrodes 40 causes or results in what is referred to by those skilled in the art as an electric wind or electrostatic fluid acceleration. In the illustrated embodiment of FIG. 2, the electric wind travels through the passage 20 in a direction depicted by arrows 44.

In one embodiment, the velocity and volume of the air moving through the passage 20 is proportional to the voltage difference between the electrodes 38, 40 and the size of the arrays. By varying the potential between the electrodes 38, 40, the size and dimensions of the passage, and the like, the velocity and volume of the electric wind can be increased and decreased over a continuous range as desired. In any particular configuration, this range may be manually adjusted with a simple adjustment knob or remote control that varies the electric potential between the electrodes 38, 40.

When the positively charged ions creating the electric wind reach the attracting electrodes 40, the positive charge is removed by permitting a recombination of the negatively charged electrons with the positively charged ions. Due to the recombination, neutral air molecules once again exist in the passage 20. Advantageously, these neutral air molecules retain their velocity and direction.

In a preferred embodiment, one or more corona discharge apparatuses 22 can be disposed within the passage 20 for the purpose of cleaning and scrubbing the air. Such beneficial and desirable filtering can be performed in addition to generating the electric wind. As known to those skilled in the art, contaminants and particles tend to adhere to the attracting electrode 40 during the corona discharge process. Therefore, the air passing through the passage 20 can be purified after having been sensed by the detector 28. The attracting electrodes 40, which are often plates, are preferably removable to permit inspection, cleaning, and replacement. In an alternative embodiment, the entire corona discharge apparatus 22 is removable.

As is known in the art, several patents and published applications have recognized that corona discharge devices may be used to generate ions and accelerate and filter fluids such as air. Such patents and published applications that describe fluid and/or air moving devices and technology include the following U.S. Pat. Nos. 3,638,058, 3,699,387, 3,751,715, 4,210,847, 4,231,766, 4,380,720, 4,643,745, 4,789,801, 5,077,500, 5,667,564, 6,176,977, 6,504,308, 6,664,741, and 6,727,657 and U.S. Pub. Pat. Applns. 2004/40217720, 2004/0212329, 2004/0183454, 2004/0155612, 2004/0004797, 2004/0004440, 2003/0234618, and 2003/0090209. The teachings and disclosure of each of these patents and published applications are incorporated in their entireties by reference thereto.

While other ion discharge or corona fluid movement technologies may be employed in the system and method of the present invention, a preferred embodiment of the present invention utilizes the technology described in one or more of the preceding patents and/or published applications, and most preferably, the technology described in U.S. Pat. Nos. 6,504,308, 6,664,741, and 6,727,657 issued to Kronos Advanced Technologies, Inc., of Belmont, Mass. The teachings and disclosure of each of these patents are also incorporated in their entireties by reference thereto.

In a preferred embodiment, the hazardous condition detector 16 further comprises an ozone depletion apparatus 46 for reducing the amount of ozone in the fluid. In general, the ozone depletion apparatus 46 is any system, device, or method having the ability to degenerate ozone into oxygen (i.e., dioxide) and/or absorb ozone. In particular, the ozone depletion apparatus 46 can be a filter, a catalyst composition situated proximate the fluid, and the like. When the hazardous condition detector 16 is equipped with the ozone depletion apparatus 46, the ozone generated by the one or more corona discharge apparatuses 22 can be maintained below a desired level, relegated to within a predetermined range, and otherwise managed.

While the ozone depletion apparatus 46 can be situated in a variety of different locations relative to the one or more corona discharge apparatuses 22, the ozone depletion apparatus is preferably disposed within the passage 20 proximate the outlet 36. In an exemplary embodiment, the ozone depletion apparatus 46 is generally downstream of the last corona discharge apparatus 22 in the hazardous condition detector 16. As such, air flowing out of the outlet 36 is purified by the ozone depletion apparatus 46 prior to entering the environment.

As is known in the art, several patents have recognized that ozone depletion devices and systems may be used to convert ozone to oxygen, absorb ozone, and the like. Such patents that describe converting and absorbing devices, methods, and technology include the following U.S. Pat. Nos. 4,343,776, 4,405,507, 5,422,331, 6,375,902, 6,375,905, and 6,699,529. The teachings and disclosure of each of these patents and published applications are incorporated in their entireties by reference thereto.

In operation, and referring to FIG. 2, air is drawn into the passage 20 of the hazardous condition detector 16 through the inlet 34 due to the activation of one or more of the corona discharge apparatuses 22 and the corona discharge process as discussed above. Once drawn inside the passage 20, the air (or particles thereof) continues to move through the passage 20 in the direction indicated by the arrows 44. While flowing through the passage 20, the air is circulated and generally moved past the sensor 28 such that the sensor can sense, measure, and/or monitor for one or more of a hazardous or potentially hazardous condition or substance as noted above.

After the air flowing through the passage 20 has been directed by the sensor 28, the air is expelled and/or exhausted into the environment through the outlet 36 by the corona discharge process. If at least one substance or condition of the air has been sensed and/or has been found to be above acceptable levels, the hazardous condition detector 16 is able to activate the alarm system 32 and generate an alarm. In a preferred embodiment, at least one of the corona discharge apparatuses 22 that can be employed in the hazardous condition detector 16 also filters and cleans the air traveling through the passage 20 of the detector, preferably after having been sensed by the sensor 28. This filtering aids in maintaining the indoor air quality (IAQ).

As will be appreciated by those skilled in the art, the hazardous condition detector 16 can quickly and reliably sense smoke and/or other hazardous substances within the living space and can be flush mounted in the ceiling 12 or wall 13 in an aesthetically pleasing manner.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A hazardous condition detector, comprising:

a body defining a passage therethrough and extending between an inlet and an outlet;

a hazardous condition sensor positioned within the passage; and at least one corona discharge apparatus positioned within the passage to draw a fluid into the passage through the inlet and to expel the fluid through the outlet.

2. The hazardous condition detector of claim 1, wherein the hazardous condition sensor is able to sense at least one of smoke, carbon monoxide, carbon dioxide, radon, mold, hot gas, and explosive gas in the fluid.

3. The hazardous condition detector of claim 1, further comprising means operatively coupled to the at least one corona discharge apparatus for varying a flow rate of the fluid through the passage.

4. The hazardous condition detector of claim 1, further comprising an alarm activatable when the hazardous condition sensor senses an elevated level of at least one of smoke, carbon monoxide, carbon dioxide, radon, mold, hot gas, and explosive gas in the fluid.

5. The hazardous condition detector of claim 1, wherein the hazardous condition detector is adapted for flush mounting in at least one of a ceiling and a wall.

6. The hazardous condition detector of claim 1, wherein the hazardous condition detector further comprises an ozone depletion apparatus for reducing ozone in the fluid.

7. The hazardous condition detector of claim 1, wherein the inlet and the outlet are generally planar.

8. The hazardous condition detector of claim 1, wherein at least one electrode in the at least one corona discharge apparatus is removable from the hazardous condition detector for at least one of inspection, cleaning, and replacement.

9. The hazardous condition detector of claim 1, wherein the at least one corona discharge apparatus permits a variable flow of the fluid to flow through the hazardous condition detector.

10. The hazardous condition detector of claim 1, wherein the at least one corona discharge apparatus comprises a positively charged emitter array in spaced relation to a negatively charged collector array.

11. The hazardous condition detector of claim 1, wherein the hazardous condition detector is one of an ionization detector, an optical detector, an electrochemical cell detector, a photoelectric detector, and combinations thereof.

12. The hazardous condition detector of claim 1, wherein the at least one corona discharge apparatus is removably positioned in the passage to allow cleaning thereof.

13. The hazardous condition detector of claim 1, further comprising a controller operatively coupled to the at least one corona discharge apparatus and the hazardous condition detector.

14. A hazardous condition detector, comprising:

a passage extending between an inlet and an outlet;

a hazardous condition sensor disposed within the passage;

an emitter array positioned in the passage; and a collector array positioned in the passage in a spaced relation to the emitter array, the emitter array and the collector array cooperatively producing an electric wind in the passage when energized such that air is drawn from an environment into the passage through the inlet, moved past the sensor, and expelled through the outlet into the environment.

15. The hazardous condition detector of claim 14, wherein the emitter array and the collector array are disposed proximate the outlet.

16. The hazardous condition detector of claim 15, wherein the hazardous condition detector further comprises a second emitter array and a second collector array in spaced relation to the second emitter array, the second emitter array and the second collector array disposed proximate the inlet.

17. The hazardous condition detector of claim 14, wherein the emitter array is disposed proximate the inlet and the collector array is disposed proximate the outlet, and wherein the hazardous condition sensor is disposed between the emitter array and the collector array.

* * * * *